US007227439B2

(12) United States Patent
Kelly

(10) Patent No.: US 7,227,439 B2
(45) Date of Patent: Jun. 5, 2007

(54) ELECTRICAL SHORT STROKE LINEAR ACTUATOR

(75) Inventor: Hugh Peter Granville Kelly, Westcliff on Sea (GB)

(73) Assignee: Hugh-Peter Granville Kelly, Essex (GB)

( * ) Notice: Subject to any disclaimer, the term of this patent is extended or adjusted under 35 U.S.C. 154(b) by 90 days.

(21) Appl. No.: 10/343,951

(22) PCT Filed: Aug. 3, 2001

(86) PCT No.: PCT/GB01/03513

§ 371 (c)(1),
(2), (4) Date: Dec. 12, 2003

(87) PCT Pub. No.: WO02/13211

PCT Pub. Date: Feb. 14, 2002

(65) Prior Publication Data

US 2004/0095219 A1 May 20, 2004

(30) Foreign Application Priority Data

Aug. 3, 2000 (GB) ..... 0019062.9
Dec. 7, 2000 (GB) ..... 0029900.8

(51) Int. Cl.
*H01H 7/00* (2006.01)

(52) U.S. Cl. ..... 335/229; 335/220; 310/15; 310/12

(58) Field of Classification Search ..... 335/220–236, 335/179; 310/12, 14, 15
See application file for complete search history.

(56) References Cited

U.S. PATENT DOCUMENTS

| | | | | |
|---|---|---|---|---|
| 4,363,980 | A * | 12/1982 | Petersen | 310/15 |
| 5,434,549 | A * | 7/1995 | Hirabayashi et al. | 335/229 |
| 5,661,446 | A * | 8/1997 | Anderson et al. | 335/229 |
| 5,947,155 | A | 9/1999 | Miki et al. | 137/625.65 |
| 6,040,752 | A * | 3/2000 | Fisher | 335/234 |
| 6,501,357 | B2 * | 12/2002 | Petro | 335/229 |
| 6,800,966 | B2 * | 10/2004 | Godkin | 310/12 |
| 6,870,454 | B1 * | 3/2005 | Vladimirescu et al. | 335/220 |

FOREIGN PATENT DOCUMENTS

| | | |
|---|---|---|
| JP | 63-129848 | 6/1963 |
| JP | 10-270243 | 9/1998 |

* cited by examiner

*Primary Examiner*—Elvin Enad
*Assistant Examiner*—Bernard Rojas
(74) *Attorney, Agent, or Firm*—Michael A. Glenn; Glenn Patent Group

(57) ABSTRACT

An electrical short stroke actuator, comprising an annular filed collar and a composite plunger for travelling therethrough. In its simplest form, the plunger comprises two permanent magnets with like poles facing, and which are housed within a thin walled tube, and separated by a central spacer. By judicious choice of the spacing of the magnets, and the length of the field coil, a substantially constant thrust profile is achieved over a pre-selected stroke of the field coil relative to the plunger. The thrust may be augmented by fabricating the means used for spacing the magnets wholly or in part from ferromagnetic material, and also adding collars, similarly fabricated, onto the outside face of each of the permanent magnets.

9 Claims, 3 Drawing Sheets

Figure 2
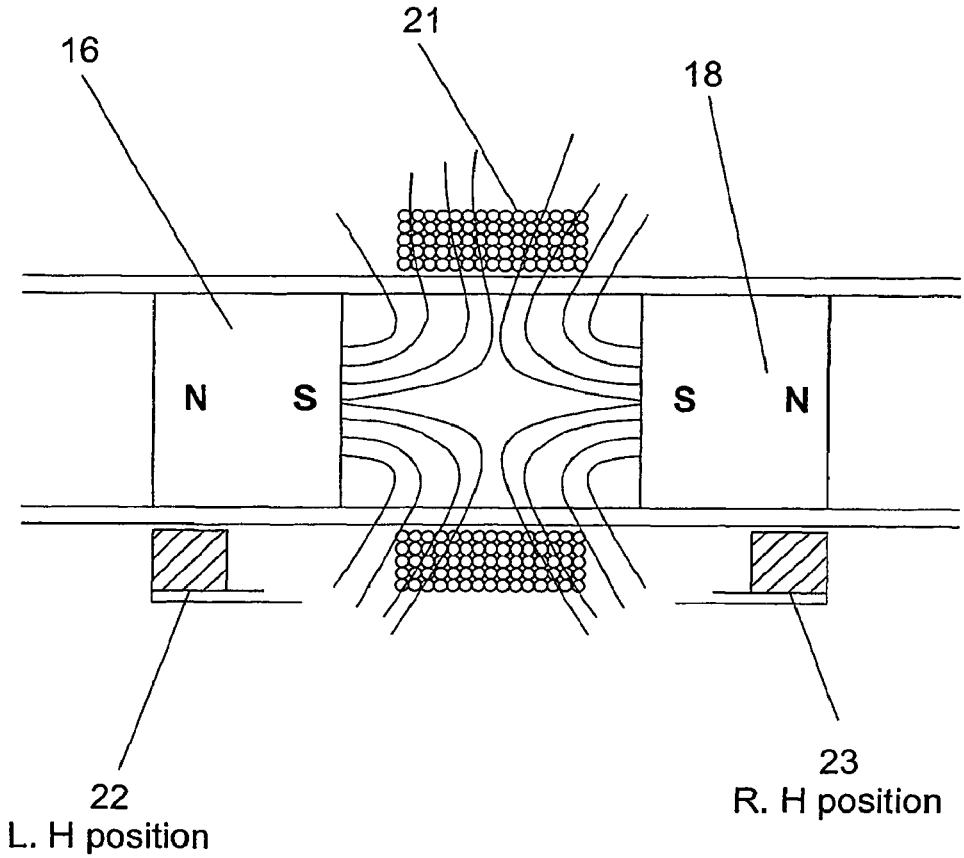
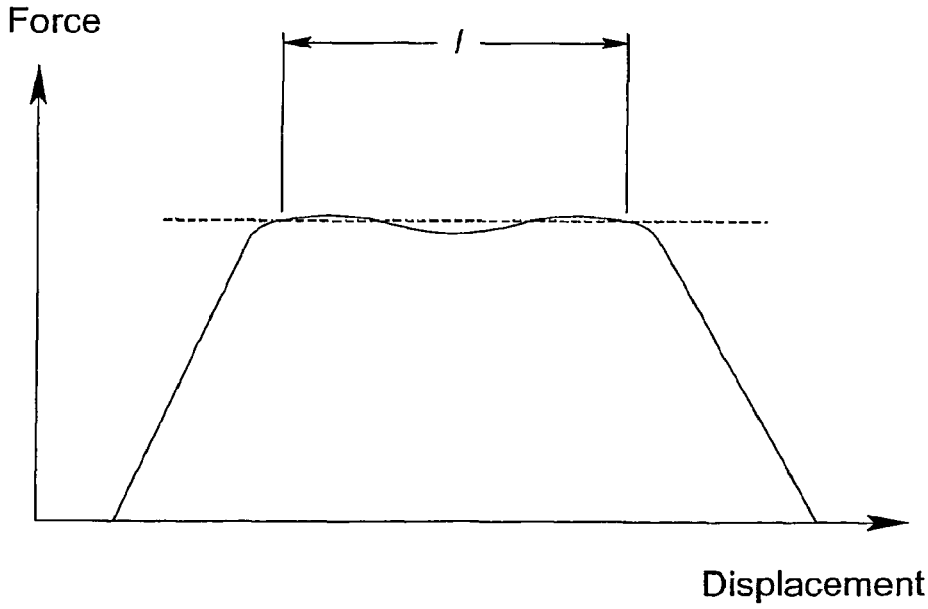
Figure 3

ELECTRICAL SHORT STROKE LINEAR ACTUATOR

The present invention relates to electrically powered short stroke actuators, having uses in applications similar to those for solenoids.

BACKGROUND TO INVENTION

The use of solenoids for providing mechanical force over a limited stroke is well known. They are used in countless applications throughout industry. Current is fed through an annular coil, and a plunger formed from ferromagnetic material is pulled into the coil when energised. It is however in the very nature of the device that as the plunger is pulled in, and reaches its point of rest, that the force experienced diminishes to zero, assuming a symmetrical disposition of coil and plunger. For many applications this is unsatisfactory, especially where a consistent force is required throughout the stroke irrespective of the physical displacement of the plunger.

Numerous design variations have been formulated to mitigate the effect of the inverse square law governing in whole or in part this effect. However, any attempt at linearisation of the solenoid's characteristics (force versus displacement) necessitates compromises in terms of electromagnetic simplicity of construction, (for example, the use of conical pole pieces and the like). Furthermore, the thrust experienced by the plunger is of course limited to the field produced by the coil.

To achieve higher forces therefore requires higher currents, resulting in higher heat loss. In fact, because heat loss is equal to the square of the current multiplied by the resistance of the coil, therefore a doubling in force requires a quadrapuling of heat dissipation capability.

STATEMENT OF INVENTION

A short stroke actuator comprises an annular field coil and a composite plunger for relative travel therethrough. The composite plunger comprises two permanent magnets axially in line but spaced one from the other and with like poles facing. The length of the annular field coil and the corresponding spacing of the permanent magnets being so selected that the thrust profile experienced in use by the coil, when energised, relative to the plunger, is substantially constant over a pre-selected stroke regardless of displacement.

Other optional features of the invention are defined in the sub claims.

OTHER FEATURES OF THE INVENTION

It should be noted that the plunger may include components for housing the magnets, such as a tube of thin wall. In addition, according to a first optional feature of the invention, additional ferromagnetic pole pieces may be introduced between the facing magnets for augmenting the effect thereof, depending upon the precise stroke to be realised, and the desired force characteristic.

It will be appreciated from the aforedescribed arrangement, that the difficulties presented by the classical solenoid construction are largely eliminated, as a virtually constant thrust profile is obtained over the desired stroke.

An additional, and important advantage of using permanent magnets is that a strong magnetic field is presented to the turns of the field coil. A far larger force is therefore realised in comparison to a classical solenoid construction of the same dimensions. The use of powerful rare earth magnets (for example Neodymium Boron Iron) can result in a near doubling of force for the same dissipation.

According to a second optional feature of the invention, the disposition of the number of turns per unit length of the field coil along the length of the field coil, may be varied to provide a specific magnetic envelope shape, for further improving the constant thrust profile experienced by the coil relative to the plunger as the pre-selected stroke is traversed.

It is well known that as a coil heats, so also does its resistance rise. Thus, should the coil be supplied from a constant voltage source, the thrust will diminish due to a reduction in the current passing therethrough. To compensate for this effect, constant current driver circuitry is frequently used. However, in the case of the actuator of the invention, a further difficulty arises inasmuch that the magnetic field emanating from the permanent magnets also diminishes with heat. (This is recoverable, provided they are not worked beyond their recovery point for any given temperature.)

According to a third optional feature of the invention, means are provided for sensing, in use, the temperature of the magnets within the plunger, and a signal provided by the aforesaid means is supplied to circuitry supplying the field coils so as to compensate the current fed thereby for any change in magnetic field strength of the magnets resulting from changes to the temperature thereof.

By this means, by both utilising circuitry which compensates for the increase in the ohmic resistance of the field coil as its temperature increases, and which also compensates for changes in magnetic field strength of the magnets similarly, the performance of the actuator may be maintained constant irrespective of its own temperature, or that of the surrounding medium in which it is operating.

For some applications, the force required of the actuator may be quite considerable, and more than can be achieved without undue heating from the arrangement so far described. According to a fourth optional feature of the invention, end collars comprised wholly or in part of ferromagnetic material are located in line and on each outside face of each magnet, and the means used for centrally spacing the magnets is comprised wholly or in part of ferromagnetic material. The effect of the combination of the ferromagnetic outside end collars with the central ferromagnetic spacer is to extend and augment the flux linking the magnets with the coil, and thereby to increase the thrust available. The end collars and central spacer may be made from tubing to reduce weight without reducing to any significant extent the effect thereof.

The invention will now be described with reference to the accompanying drawings in which:

BRIEF DESCRIPTION OF DRAWINGS

FIG. 2 shows magnetic field patterns emanating from the magnetic plunger of the actuator.

FIG. 3 shows force/displacement characteristics of the actuator

SPECIFIC DESCRIPTION

Figure 1:
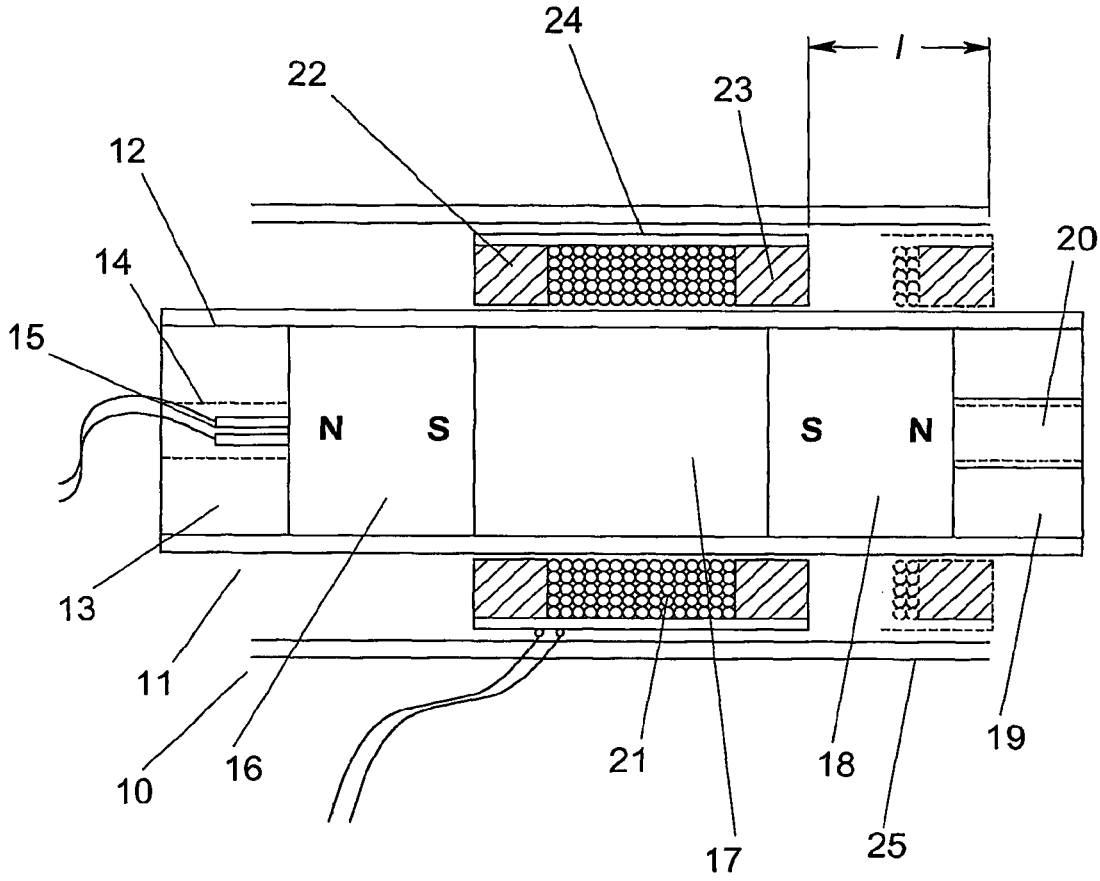
FIG. 1 shows the component parts of an actuator constructed in accordance with the invention

Referring to FIG. 1, an actuator of the invention is depicted at 10. The plunger of the actuator is shown at 11 and comprises a thin walled tube 12 housing a sequence of components. The first of these is a non-ferromagnetic end collar 13, equipped with a hole 14 for accommodating a temperature sensor 15. (The use of this will be described in detail later.) The next component is a permanent magnet 16, of polarity as shown, ie magnetised axially. The following component 17 is a central spacer, which may be fabricated from a non-ferromagnetic material, or partly comprise some ferromagnetic material, depending upon the desired characteristics. Component 18 is a further permanent magnet, polarity as shown, ie like poles of magnets 16 and 18 facing one another. The tube is completed with component 19, being a final non-ferromagnetic collar for closing the tube. The collar may be furnished with a central screw thread 20 for connection to mechanisms.

A travelling annular field coil 21 is mounted for slidable movement along the thin walled tube 12. It is guided therealong by bearings 22 and 23 at each end, these bearings being contained within a further thin walled tube 24, as is the coil.

The action of the actuator is as follows. When current of the appropriate polarity is fed to the coil, the lines of force produced thereby interact with the field pattern emanating from the plunger. This is illustrated with reference to FIG. 2 in which it is seen that the lines of force produced by the magnets are forced to radiate outwards by virtue of the fact that their poles are in repulsion. As a result of this interaction, the coil experiences a force, in accordance with Fleming's rule. The coil is permitted to move over a preselected length—stroke— indicated by "I" in FIGS. 1 & 2. The force rendered is largely independent of displacement for the following reasons. When the coil is in its left hand position, it experiences at its centre, powerful fields emanating from the south pole of the magnet. In its central position, the effective field from the first magnet cutting the turns is weakened, but is doubled overall because of the effect of the right hand magnet. As the coil travels to the right, so the full field of the right hand magnets cuts the turns, as did the left hand magnet.

By judicious spacing of the magnets, and selecting the appropriate length of the field coil 21, so a substantially even thrust profile is achieved. This is illustrated at FIG. 3.

Where an enhanced performance is required, the end collars 13 and 19 may each be fabricated in part or wholly from ferromagnetic material, and similarly the central spacer 17. The effect of this is to extend and augment the field linkage with the coil 21, and thereby increase the performance of the actuator. To save weight, the end collars and central spacer may be made of tubing, of reasonable wall thickness, without significantly reducing the thrust obtained. A penalty of this arrangement is that the force versus displacement profile may not be as consistent as when non-ferromagnetic components are used, but nevertheless remains within acceptable boundaries for most applications requiring a constant thrust.

An additional ferromagnetic sleeve 25, see FIG. 1, may be situated around the whole assembly, to help draw out the lines of force from the magnets, and so augment the force provided. Alternatively, the tube 24 may be ferromagnetic where force is considered more important than an even thrust profile. In this case, the length may be carefully chosen to reduce the effects of cogging, and thus disruption of the constant force characteristic.

Figure 4:
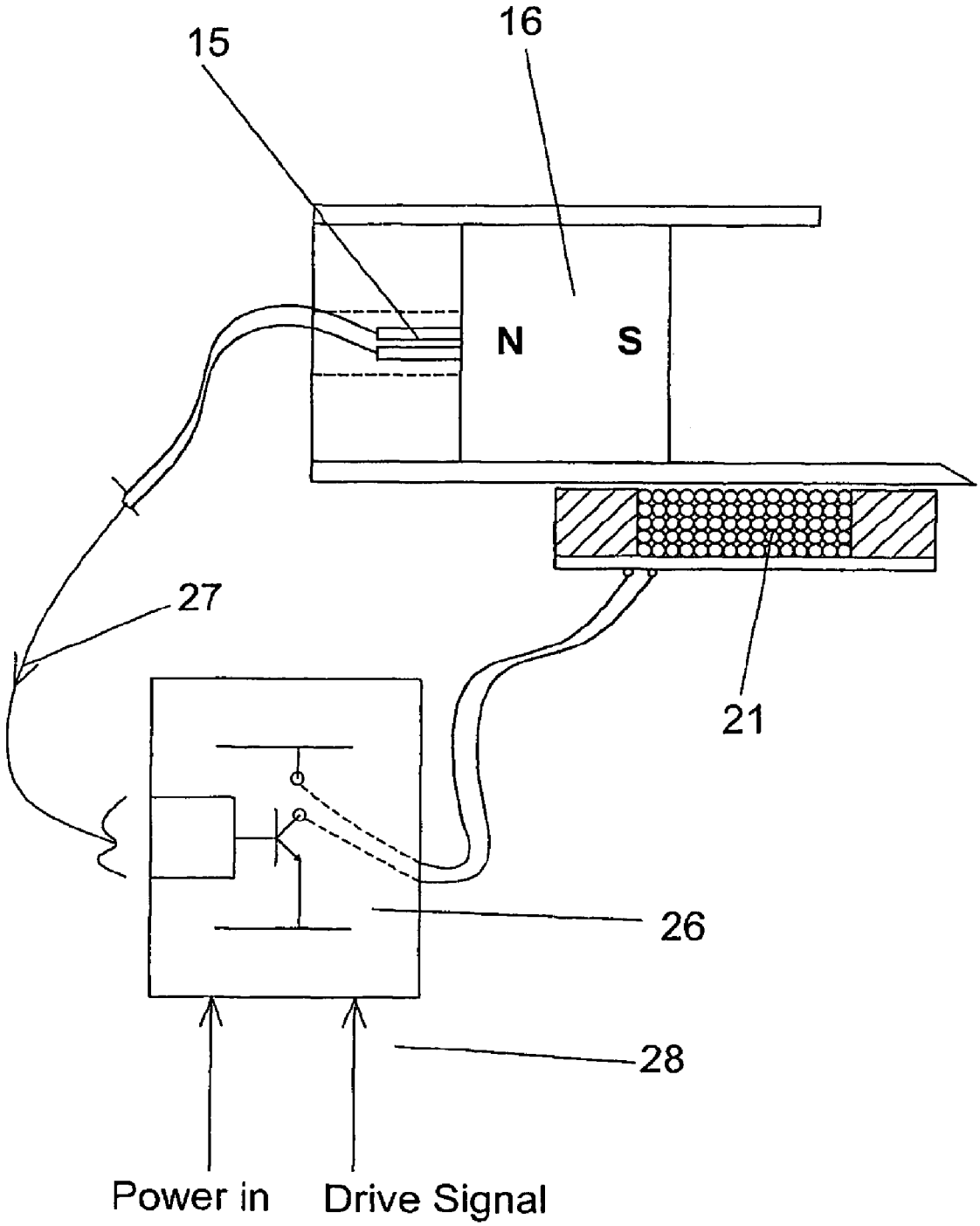
FIG. 4 shows sensing means for detecting the temperature of the plunger of the actuator, and control circuitry for supplying the field coils thereof.

Referring now to FIG. 4, temperature sensing means are mounted within the end collar, as shown at 15. This is connected to control circuitry 26 used to power the field coil 21 of the actuator.

The action of the sensor is as follows. During use, or simply because of the ambient temperature in which the actuator is used, the plunger may become hotter. This adversely affects the field strength emanating from the magnets. Thus the sensing means provides by means of the signal 27, the necessary information permitting the circuitry 26, to increase the current in direct fashion according to the drop in field strength, and thereby to maintain a constant force irrespective of the increase in temperature of the plunger. Also accommodated within the control circuitry is a constant current driver (supplemented by the signal from the temperature sensing means), for compensating for the ohmic increase of the field coil with temperature.

Thus, by the combination of the action of the temperature sensor 15, and the ohmic current compensation, the force provided by the actuator is held unaffected by temperature, within a reasonable operating range, and is only dependent upon the drive signal supplied to the control circuitry at 28.

Numerous variations will be apparent to those skilled in the art.

The invention claimed is:

1. A short stroke actuator comprising an annular field coil and a composite plunger for relative travel threrethrough, the composite plunger comprising two permanent magnets axially in line but spaced one from the other and with like poles facing, the length of the annular field coil and the corresponding spacing of the permanent magnets being so selected that the thrust experienced in use by the coil, when energised, relative to the plunger by interaction of the magnetic field produced by energization of the coil with the magnetic fields produced by the permanent magnets, is substantially constant over a pre-selected stroke regardless of displacement, the stroke spanning a range of relative displacements, at each end of which range the thrust is produced by interaction of the magnetic field of the coil predominantly with the magnetic field of a respective one of the permanent magnets and, intermediate said ends, the thrust is produced by interaction of the magnetic field of the coil with the magnetic fields of both magnets.

2. An actuator according to claim 1, wherein the plunger comprises a thin walled tube for housing the permanent magnets and the means used for spacing them.

3. An actuator according to claim 1, wherein the coil of the actuator is housed within a tube, which also serves to house on either side of the coil, annular bearings for guiding the coil along the plunger.

4. An actuator according to claim 3, wherein the thin walled tube is ferromagnetic.

5. An actuator according to claim 1, in which additional end collars, fabricated wholly or in part from ferromagnetic material, are positioned on the outside face of each of the permanent magnets, and the means used for spacing the magnets is also fabricated wholly or in part from ferromagnetic material.

6. An actuator according to claim 5, in which the end collars, and/or the central spacing means are fabricated from ferromagnetic tubing.

7. An actuator according to claim 1, in which a temperature sensor is positioned to detect the operating temperature of the permanent magnets for providing a corrective signal to electronic circuitry driving the coil of the actuator to compensate for any reduction in field strength of the permanent magnets.

8. An actuator according to claim 1, wherein with the plunger in its axially central position relative to the coil, the region of the plunger aligned with the field coil substantially consists of a region between the opposed poles of the two permanent magnets.

9. An actuator according to claim 1, wherein with the plunger in its axially central position the permanent magnets underlie and partly project axially beyond the coil.

* * * * *